US008550046B2

(12) United States Patent
Terfloth et al.

(10) Patent No.: US 8,550,046 B2
(45) Date of Patent: Oct. 8, 2013

(54) HYDRAULIC CAMSHAFT ADJUSTER

(75) Inventors: Bernhard Terfloth, Remscheid (DE); Antonio Casellas, Siegburg (DE); Rainer Schmitt, Wachtberg (DE); Eberhard Ernst, Eichenzell (DE)

(73) Assignee: GKN Sinter Metals Holding GmbH, Radevormwald (DE)

( * ) Notice: Subject to any disclaimer, the term of this patent is extended or adjusted under 35 U.S.C. 154(b) by 98 days.

(21) Appl. No.: 12/966,774

(22) Filed: Dec. 13, 2010

(65) Prior Publication Data

US 2011/0126785 A1 Jun. 2, 2011

Related U.S. Application Data

(63) Continuation of application No. PCT/EP2009/004172, filed on Jun. 10, 2009.

(30) Foreign Application Priority Data

Jun. 18, 2008 (DE) ..... 10 2008 028 640

(51) Int. Cl.
*F01L 1/34* (2006.01)

(52) U.S. Cl.
USPC ..... 123/90.17

(58) Field of Classification Search
USPC ..... 123/90.15, 90.17; 464/160, 161; 74/568 R
See application file for complete search history.

(56) References Cited

U.S. PATENT DOCUMENTS

| | | | | |
|---|---|---|---|---|
| 6,311,655 | B1 | 11/2001 | Simpson et al. | |
| 6,412,462 | B1 | 7/2002 | Lichti | |
| 7,640,902 | B2 * | 1/2010 | Knecht et al. | 123/90.17 |
| 2007/0266970 | A1 * | 11/2007 | Ogawa | 123/90.15 |

FOREIGN PATENT DOCUMENTS

| | | | |
|---|---|---|---|
| DE | 10 2004 047817 | B3 | 12/2005 |
| DE | 10 2005 026553 | B3 | 9/2006 |
| DE | 10 2005 037525 | A1 | 2/2007 |

OTHER PUBLICATIONS

International Search Report, Written Opinion and Preliminary Report on Patentability Corresponding to PCT/EP2009/004172.
European Patent Office, International Preliminary Report on Patentability for corresponding International Application No. PCT/EP2009/004172, dated Sep. 20, 2010, and translation.

* cited by examiner

*Primary Examiner* — Thomas Denion
*Assistant Examiner* — Daniel Bernstein
(74) *Attorney, Agent, or Firm* — Quarles & Brady LLP

(57) ABSTRACT

A hydraulic cam shaft adjuster has a driven outer body comprising at least one hydraulic chamber, and an inner body disposed on the inside of the outer body (4), which can be firmly attached to the camshaft and has at least one pivoting wing extending into the hydraulic chamber in the radial direction, thus partitioning the hydraulic chamber into a first working chamber and a second working chamber. The inner body has at least one oil inlet and oil outlet conduit extending from a jacket interior to a jacket exterior of the inner body up to one of the two working chambers. The inner body is assembled using at least one first element and one second element, wherein the two elements each have at least one geometry at front sides facing each other, forming the oil inlet and oil outlet conduit of the inner part together with the other element.

20 Claims, 22 Drawing Sheets

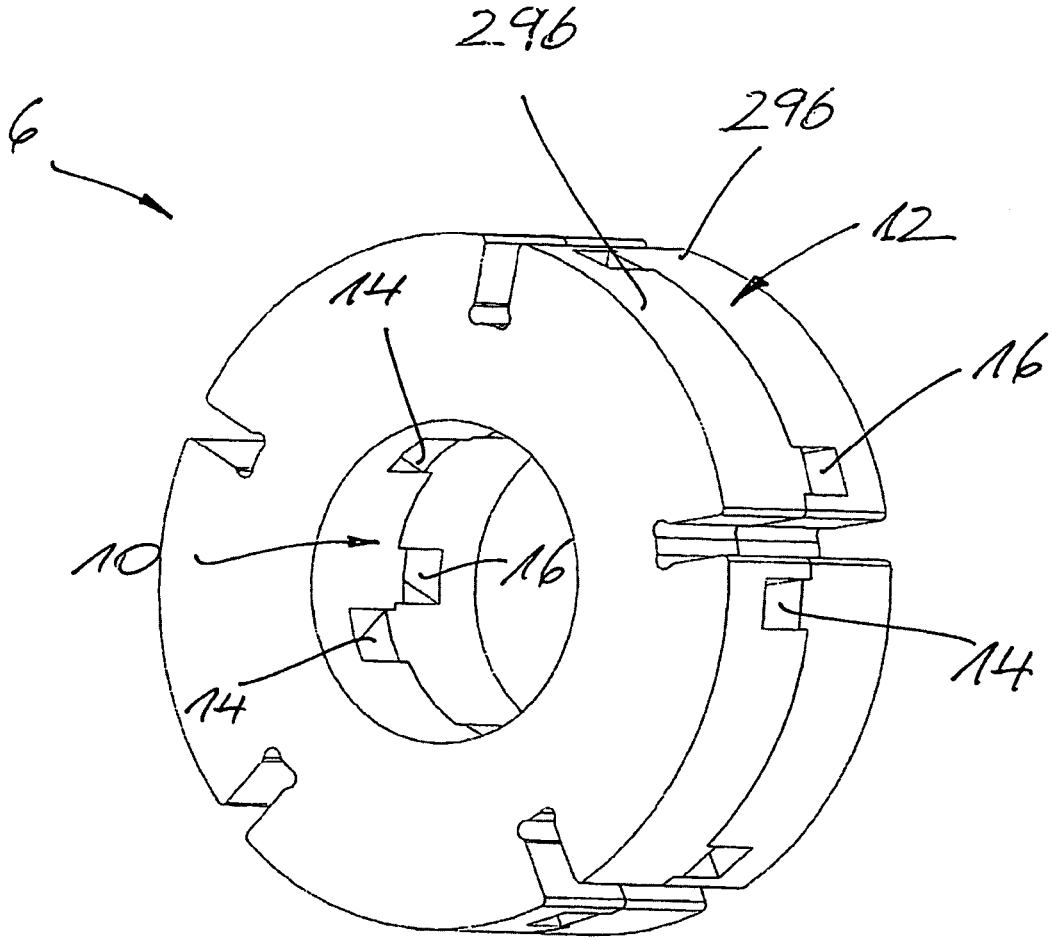
— Fig. 18 —

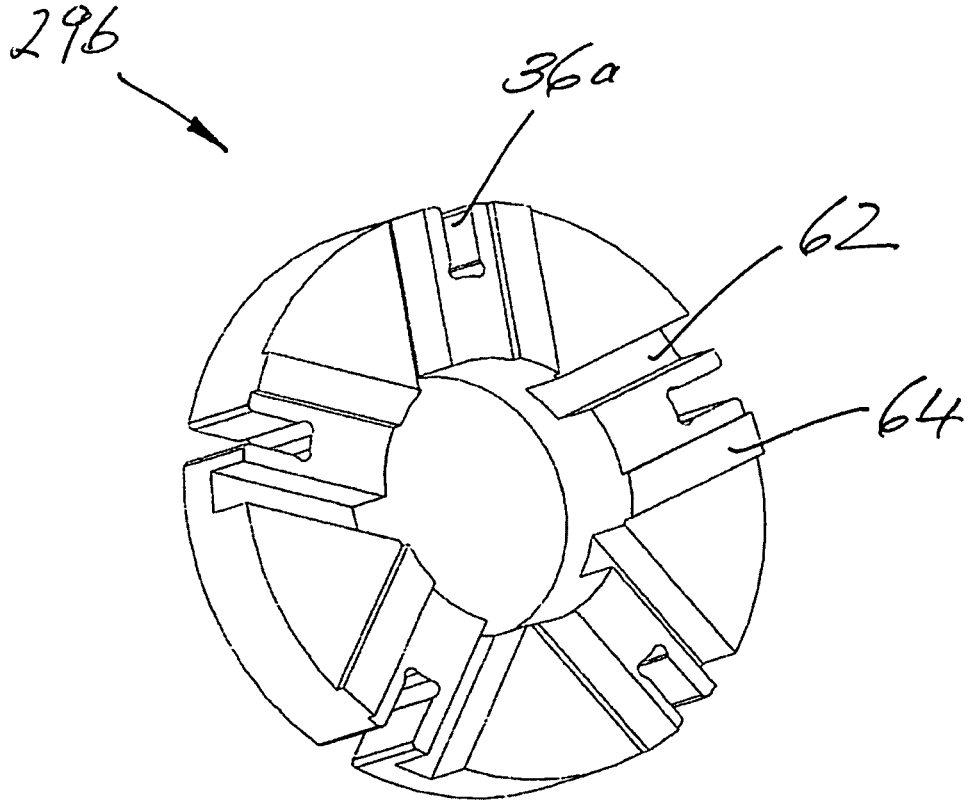
— Fig. 19 —

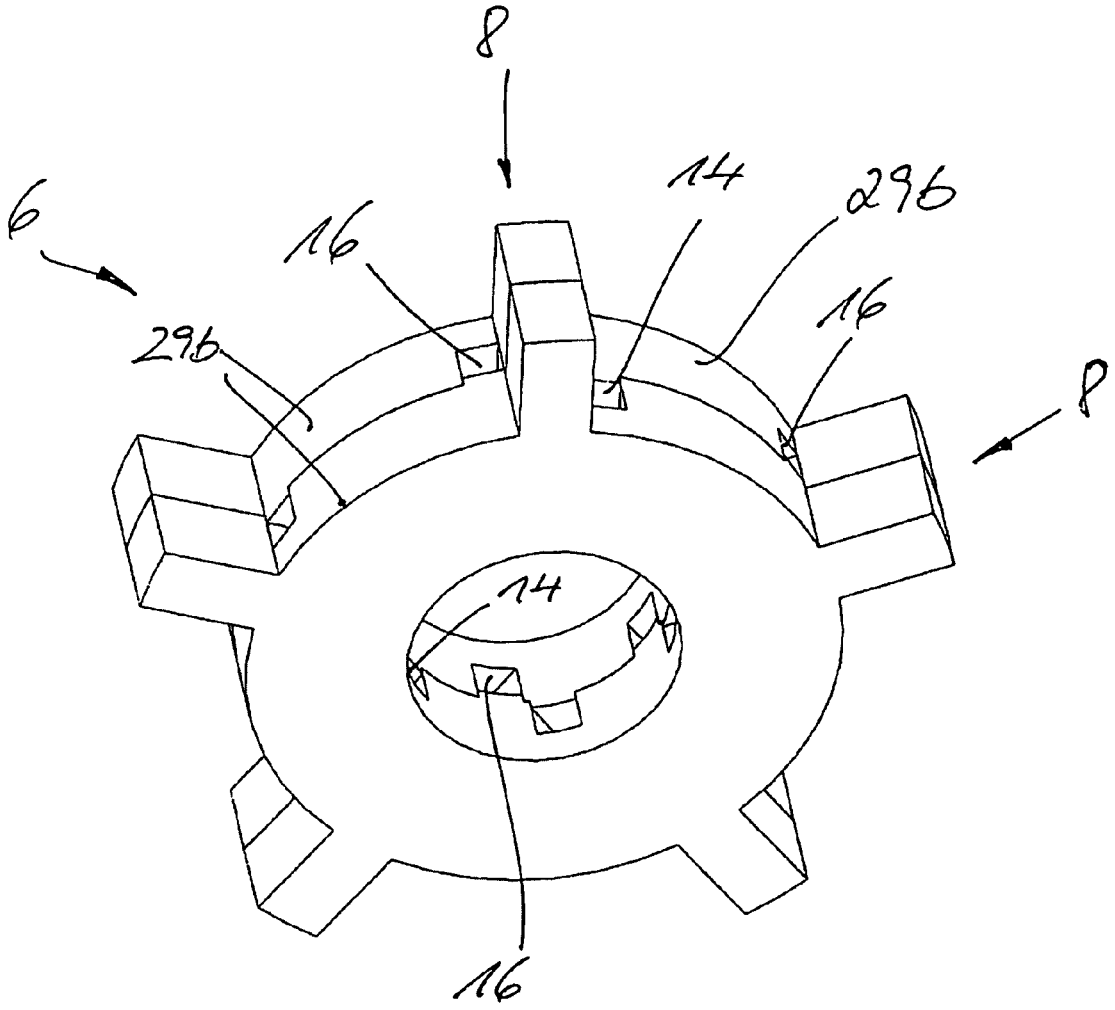
— Fig. 20 —

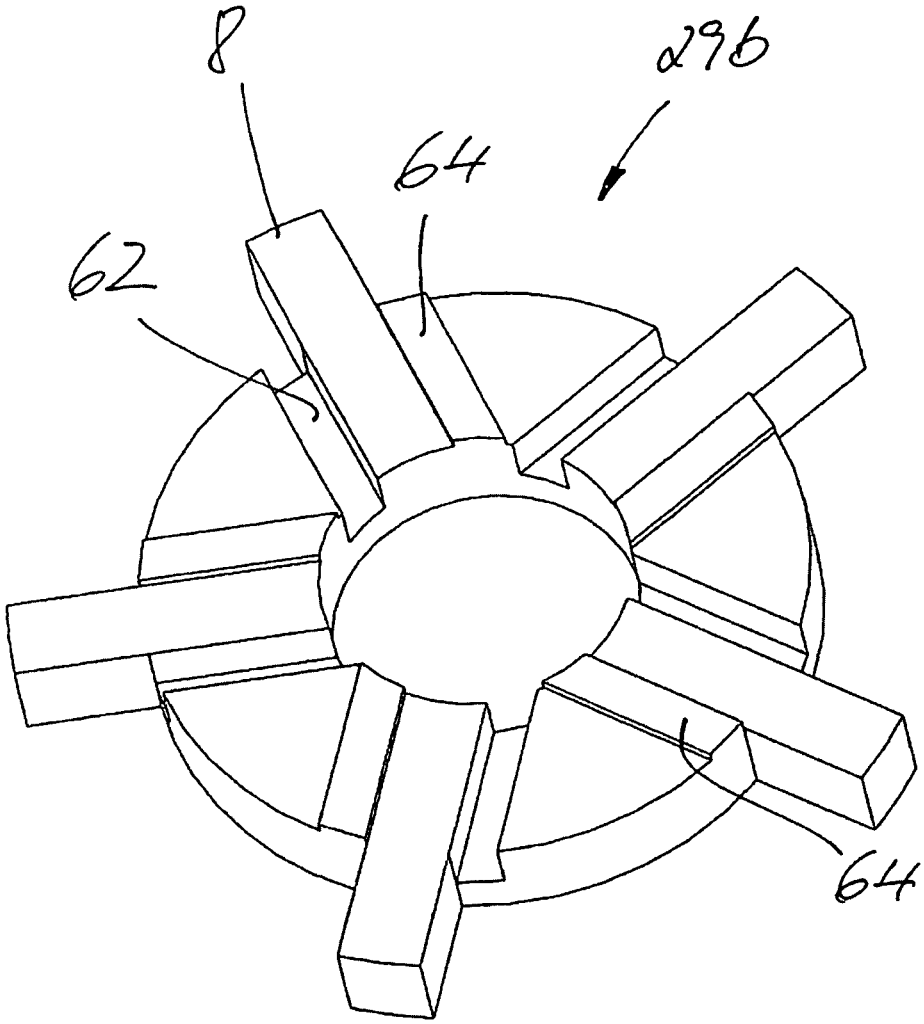
— Fig. 21 —

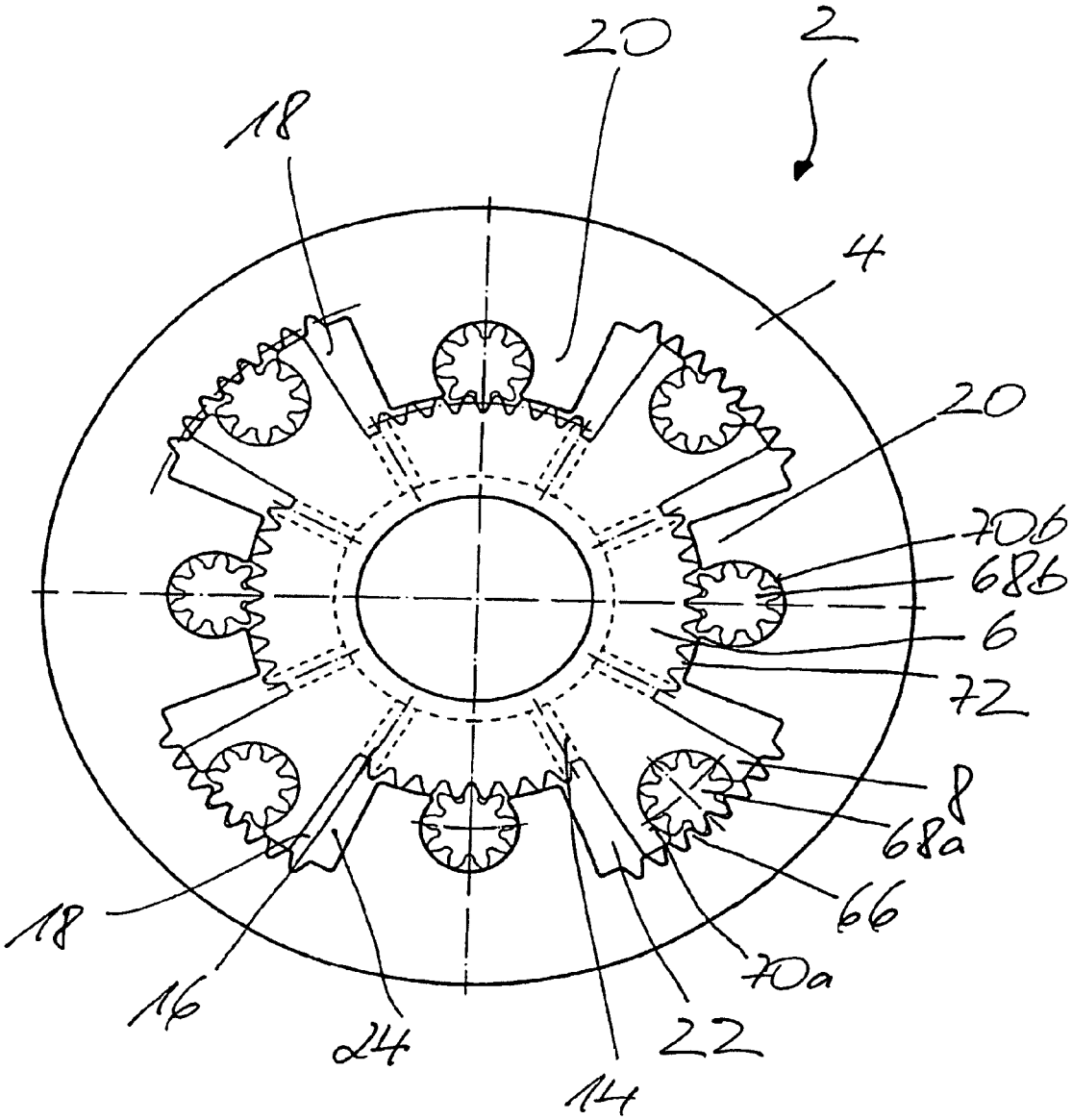
— Fig. 22 —

HYDRAULIC CAMSHAFT ADJUSTER

CROSS-REFERENCE TO RELATED APPLICATIONS

This application is a continuation of prior PCT Application No. PCT/EP2009/004172, filed Jun. 10, 2009, which claims priority of German Application No. 10 2008 028 640.0, filed on Jun. 18, 2008.

The invention relates to a hydraulic camshaft adjuster for a camshaft of an internal combustion engine.

Various embodiments of hydraulic camshaft adjusters constructed in accordance with the vane cell principle are known from the prior art. "Vane cell adjusters" are also mentioned in this context.

A camshaft adjuster can be used to change a phase position of a camshaft of an internal combustion engine relative to a crankshaft of the internal combustion engine, the crankshaft driving the camshaft. As a result, fuel consumption and uncleaned emissions from the internal combustion engine can be reduced, and performance and torque characteristics of the internal combustion engine can be improved.

A vane cell adjuster of the generic type is known, for example, from the document DE 10 2004 022 097 A1. The vane cell adjuster here comprises an outer body which can be driven via a crankshaft, and an inner body which is arranged on the inside of the outer body and can be fixedly connected to a camshaft. The inner body is adjusted in relation to the outer body and therefore the phase position of the camshaft relative to the crankshaft is changed by a controlled supply of oil from an oil circuit of an internal combustion engine to individual hydraulic or working chambers of the camshaft adjuster via oil inlet and oil outlet conduits formed in the inner body and by a buildup of pressure, which is associated with the supply of oil, in the oil inlet and oil outlet conduits and the chambers.

Both the outer body and the inner body of a vane cell adjuster of this type can be produced, as is known, by sintering. In the production of sintered parts, metal powders are compressed to form work pieces or compacts, which are also referred to as green compacts, and the work pieces are subsequently sintered. During the sintering operation, the work pieces obtain their definitive strength by the metal powders forming a cohesive crystal structure by means of diffusion and recrystallization operations as they pass through a sintering furnace.

The work piece height achieved during the compaction of the metal powders may differ in this case from a desired height. Said deviations are caused, firstly, by inaccuracies which are associated with filling a compression mold of a compression device and, secondly, by elasticities and/or frictional conditions in the compression device, which are subject to variation over time.

Finally, the above-described oil inlet and oil outlet conduits are drilled into the inner body produced by sintering, said conduits extending from a casing interior to a casing exterior of the inner body and as far as the associated hydraulic chambers. Said bores are finally also deburred.

The present invention is therefore based on the object of providing a hydraulic camshaft adjuster in the form of a vane cell adjuster which can be produced more simply by sintering.

This object is achieved by a hydraulic camshaft adjuster with the features of claim 1. The features indicated in the dependent claims are the subject matter of preferred refinements and developments of the solution. Furthermore, further advantageous features which can be the subject matter of further refinements and developments of the solution are indicated in the description below. Said further features may be combined with one another and/or with the features of the wording of the claims.

A hydraulic camshaft adjuster for a camshaft of an internal combustion engine is proposed, the camshaft adjuster being designed in the manner of a vane cell adjuster. The camshaft adjuster comprises an outer body which can be driven by means of a crankshaft of the internal combustion engine and has at least one hydraulic chamber, and an inner body which is preferably arranged coaxially on the inside of the outer body and can be fixedly connected to the camshaft. In this case, a fixed connection is to be understood as meaning a form-fitting and/or frictional connection between the inner body and the camshaft.

The inner body comprises at least one pivoting vane which extends in the radial direction into the hydraulic chamber and divides the hydraulic chamber into a first working chamber and a second working chamber. The inner body furthermore comprises at least one oil inlet and oil outlet conduit extending from a casing interior to a casing exterior of the inner body and as far as one of the two working chambers, wherein the inner body can be pivoted in relation to the outer body in order to adjust the camshaft by production of a controlled hydraulic pressure in the oil inlet and oil outlet conduit and in one of the working chambers.

The inner body is furthermore fitted together at least from a first element and a second element, the two elements each having at least one geometry on mutually facing end sides, said geometry together with the respective other element forming the oil inlet and oil outlet conduit of the inner part, in an advantageous refinement of the invention, the two elements have a substantially radial extent over the circumference. According to the invention, the two elements also have a substantially axial extent over the circumference.

A geometry here is to be understood as meaning a recess in the particular element, the recess extending from the casing interior as far as the casing exterior of the inner body and not penetrating the element in the longitudinal direction thereof.

An advantage of the proposed camshaft adjuster is that the further machining associated with the previously described production of an inner body of this type by sintering is unnecessary for the production of the oil inlet and oil outlet conduit. The further machining may also comprise deburring the oil inlet and oil outlet conduit. Said oil inlet and oil outlet conduit is instead produced by fitting together the two elements which together form the inner body. The separating gap formed by the two elements is tightly sealed hydraulically.

Furthermore, the thinner configuration of the two elements in relation to a single-part configuration of the inner body, which is known from the prior art, advantageously enables lower tolerances to be achieved in the longitudinal direction of the inner body with regard to a height achieved during compaction of metal powders to form "green compacts".

The inner body preferably has at least two pivoting vanes which each extend into a hydraulic chamber of the outer body. In a preferred refinement of the camshaft adjuster, the inner body has four pivoting vanes which each extend into a hydraulic chamber of the outer body. In a further preferred refinement of the camshaft adjuster, the inner body has five pivoting vanes which each extend into a hydraulic chamber of the outer body.

In a preferred refinement of the camshaft adjuster, the end side of at least one of the two elements has at least one projection which, in order to connect the two elements, engages in a form-fitting manner in a corresponding recess in the other element and, in the process, forms a press fit with the recess. The projection here may be formed in the manner of a claw or a web, wherein a web is to be understood as meaning a projection formed in a similar manner to a feather key. The end side of at least one of the two elements preferably has a plurality of projections which, when the two elements are fitted together, engage in a form-fitting manner in corresponding recesses in the other element, with it being possible for the projections to be both claw-like and web-like projections.

In a further preferred refinement of the camshaft adjuster, the two fitted-together elements are of identical design and each have at least one projection which extends from the casing interior as far as the casing exterior, engages, in order to connect the two elements, in a form-fitting manner in a corresponding recess in the respective other element and, in the process, forms a press fit with the recess, the two projections together with the associated recesses each forming an oil inlet and oil outlet conduit of the inner part.

An advantage of this refinement is that, in connection with the previously described production of inner bodies of this type by sintering, only one pressing tool is required in order to produce work pieces of identical configuration.

The oil inlet and oil outlet conduit preferably extends in the radial direction from the casing interior to the casing exterior of the inner body. The oil inlet and oil outlet conduit preferably has a quadrangular cross-sectional shape which is caused by the geometries on the end sides of the two fitted-together elements. In this case, the geometries on the end sides can also form other cross-sectional shapes, for example a circular or triangular shape.

In a further preferred refinement of the camshaft adjuster, a spring is arranged between the outer body and the pivoting vane in the other working chamber, said spring having a resetting effect with respect to the pivoting of the inner body.

In a further particularly preferred refinement of the camshaft adjuster, at least one first oil inlet and oil outlet conduit and one second oil inlet and oil outlet conduit are provided, the first oil inlet and oil outlet conduit extending as far as one of the two working chambers while the second oil inlet and oil outlet conduit extends as far as the other working chamber.

The pivoting vane can be formed integrally with the inner body. As an alternative, the pivoting vane can be inserted into the inner body at the casing exterior. In this case, a receptacle for the pivoting vane is provided on at least one of the two elements at the casing exterior. As an alternative, the receptacle may also be formed in two parts and a receptacle for the pivoting vane can be provided on each of the two elements. In this case, the receptacle is preferably formed on the projection. Furthermore, the receptacle is preferably formed in the manner of a slot and aligned with respect to the longitudinal direction of the inner body. The pivoting vane here is preferably guided movably in the receptacle.

In a further preferred refinement of the camshaft adjuster, a planet wheel is arranged between the pivoting vane and the outer body, a gear wheel segment corresponding to the planet wheel being formed on the outer body and interacting with the planet wheel, and a pocket into which the planet wheel is inserted being formed on the pivoting vane. Furthermore, a planet wheel is arranged between a hollow cylinder core of the inner body and the outer body on both sides of the hydraulic chamber, a gear wheel segment corresponding to the associated planet wheel being formed on the hollow cylinder core on both sides of the hydraulic chamber and interacting with the planet wheel, and a pocket into which the associated planet wheel is inserted being formed on the outer body on both sides of the hydraulic chamber.

For more specific details in this connection reference is made to the document DE 10 2004 047 817 B3 which discloses such a configuration of a hydraulic camshaft adjuster in the form of a vane cell adjuster and which is hereby incorporated fully in the disclosure of the invention.

In a further preferred refinement of the camshaft adjuster, the outer body and the two fitted-together elements of the inner body are designed as sintered parts. In this case, the two elements can already be fitted together as compacts or green compacts which obtain their definitive strength as work pieces during the sintering operation.

Exemplary embodiments of the invention are explained in detail below with reference to the drawings. The features emerging from the drawings and from the associated descriptions are not limited to the respective exemplary embodiments. Said features should also not be interpreted as being limiting. On the contrary, said features serve to illustrate an exemplary use. Furthermore, with regard to possible further refinements and developments of the solution, the individual features can be combined with one another and with features from the above description to form further refinements which are not specifically illustrated. In the drawings:

Figure 1:
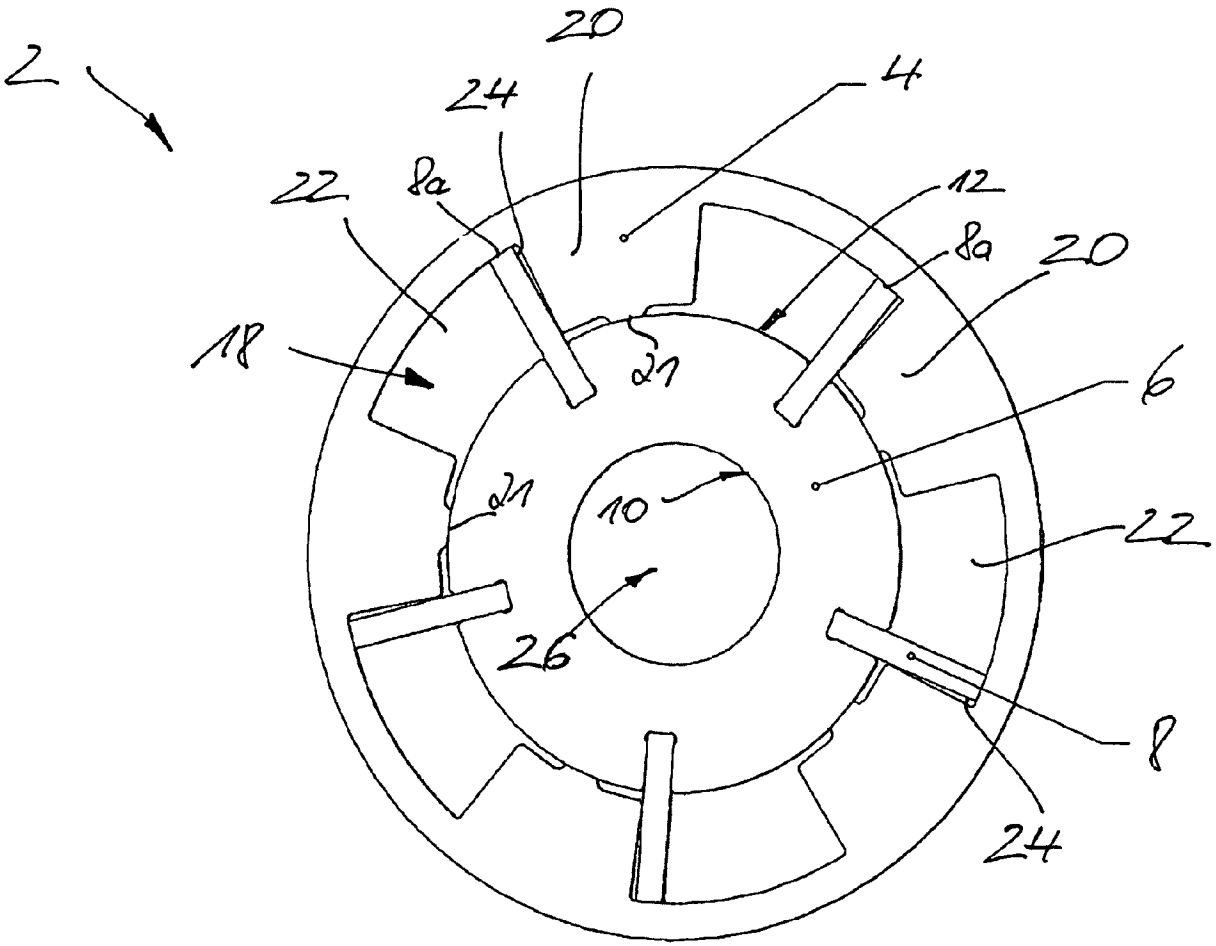
FIG. 1 shows a front view of a unit of a vane cell adjuster.
Figure 2:
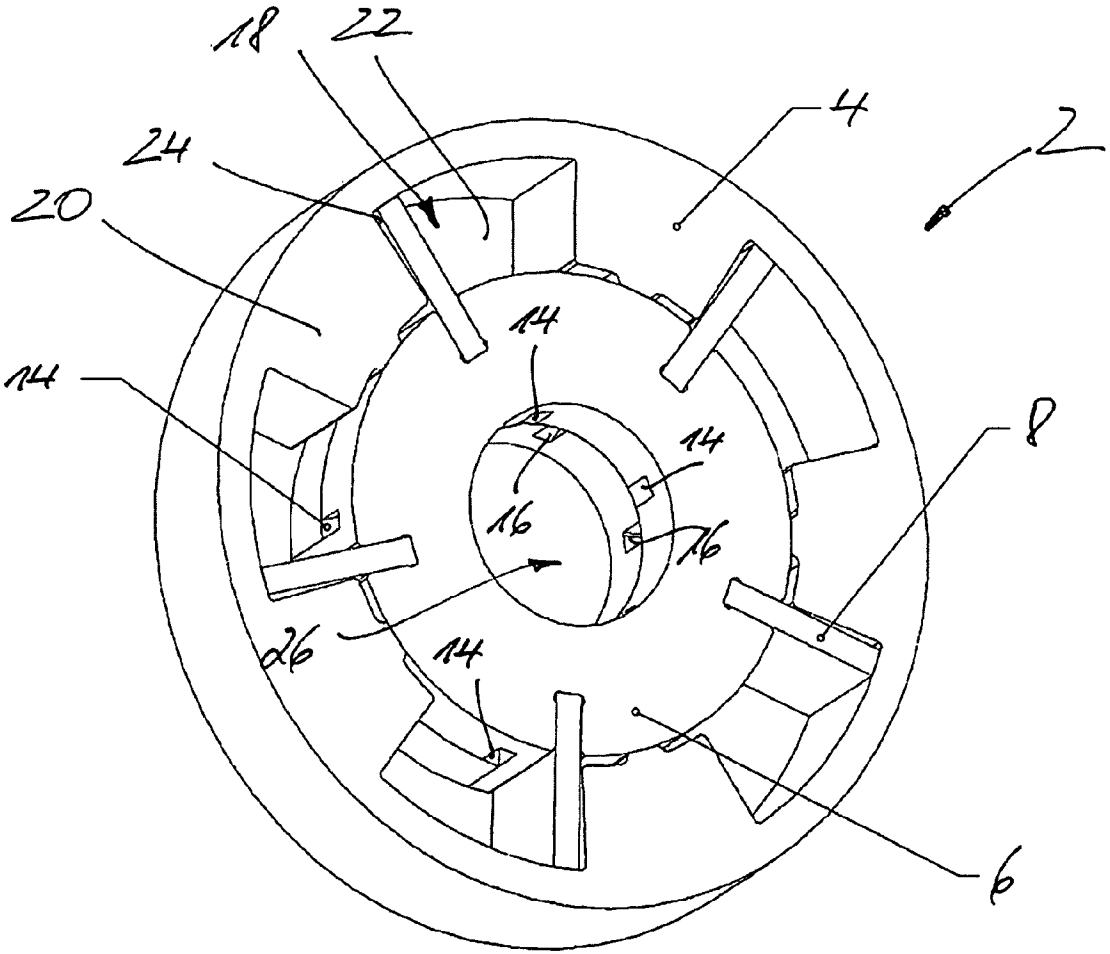
FIG. 2 shows a perspective view of the unit shown in FIG. 1.
Figure 3:
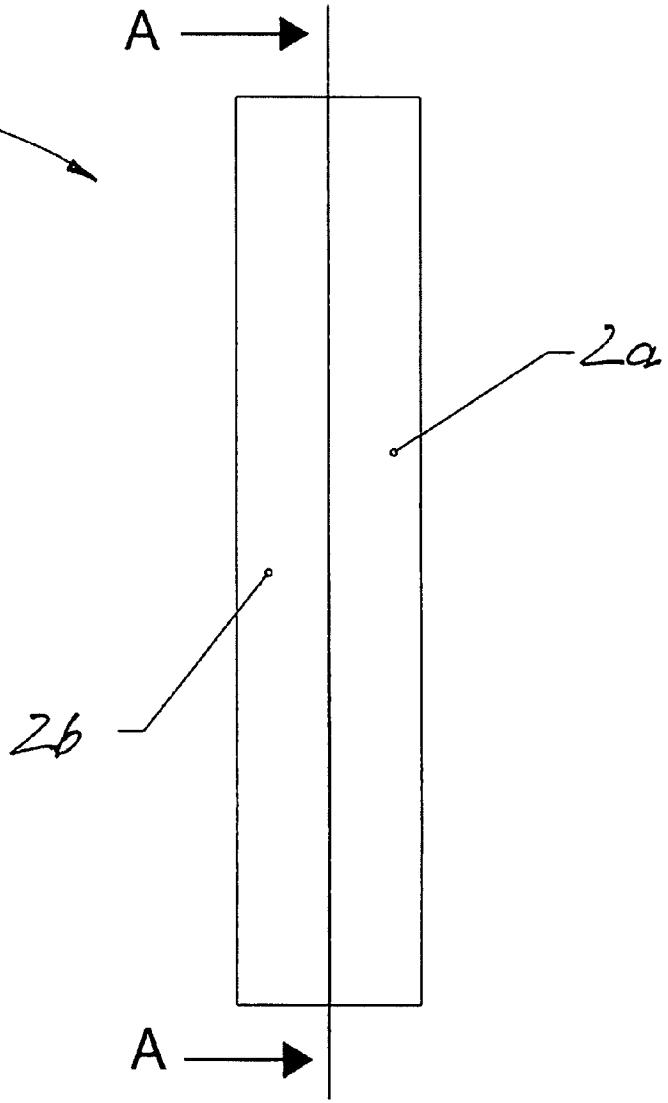
FIG. 3 shows a side view of the unit shown in FIG. 1.
Figure 4:
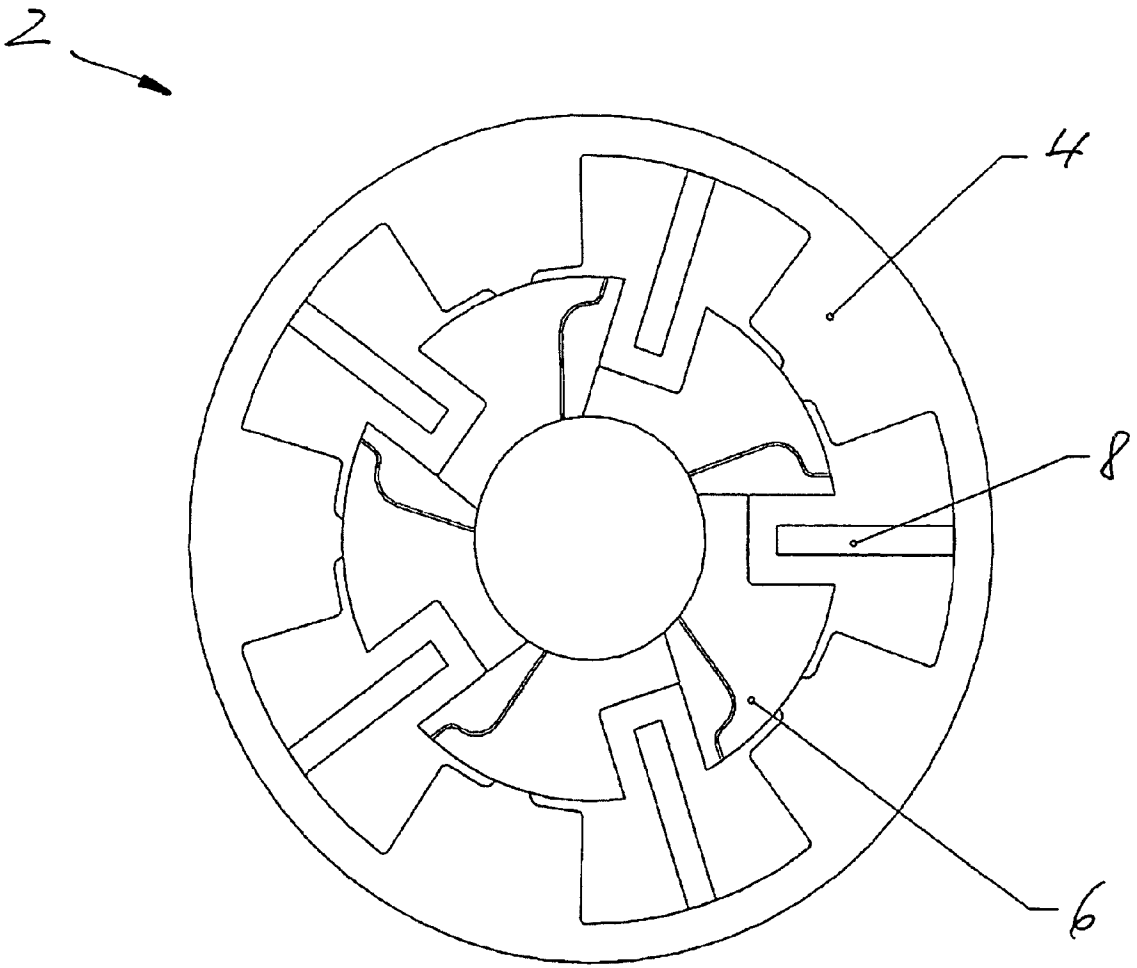
Figure 5:
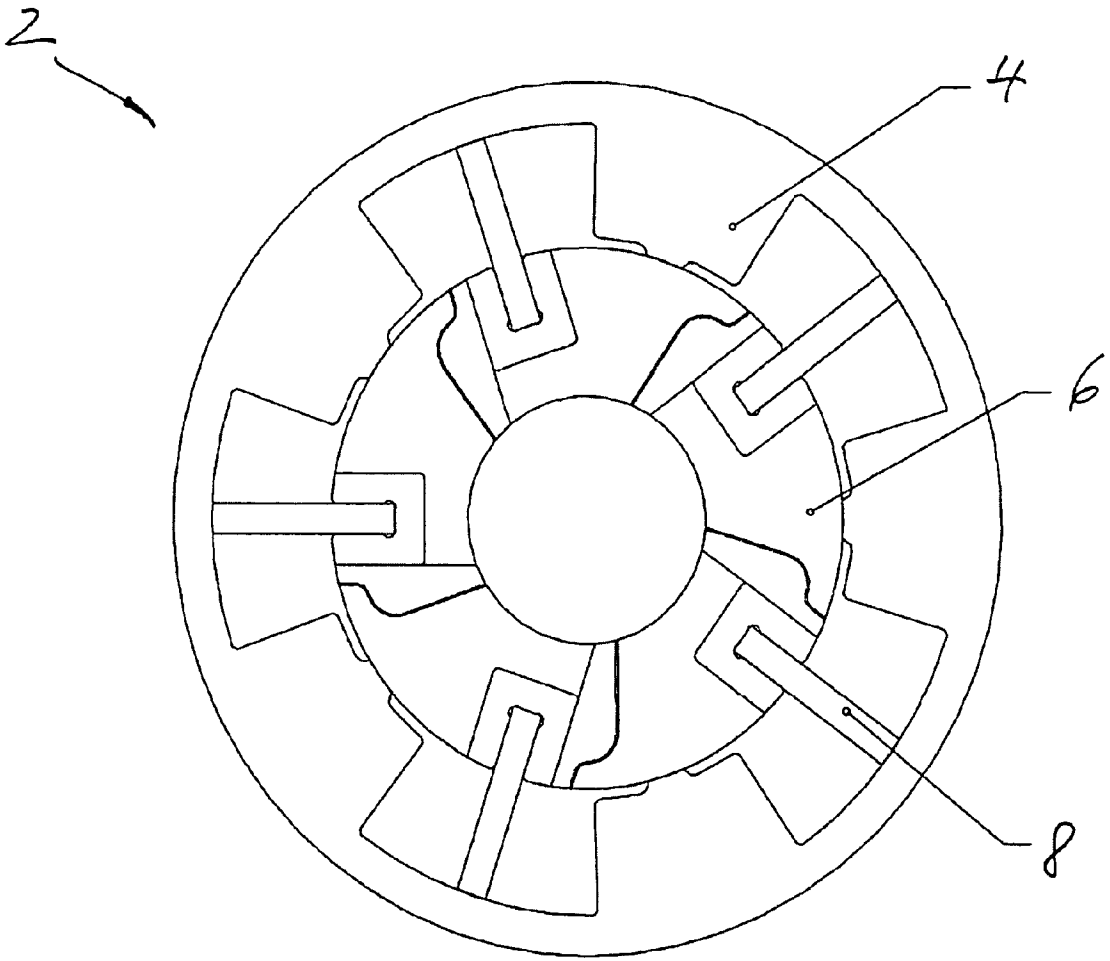
Figure 6:
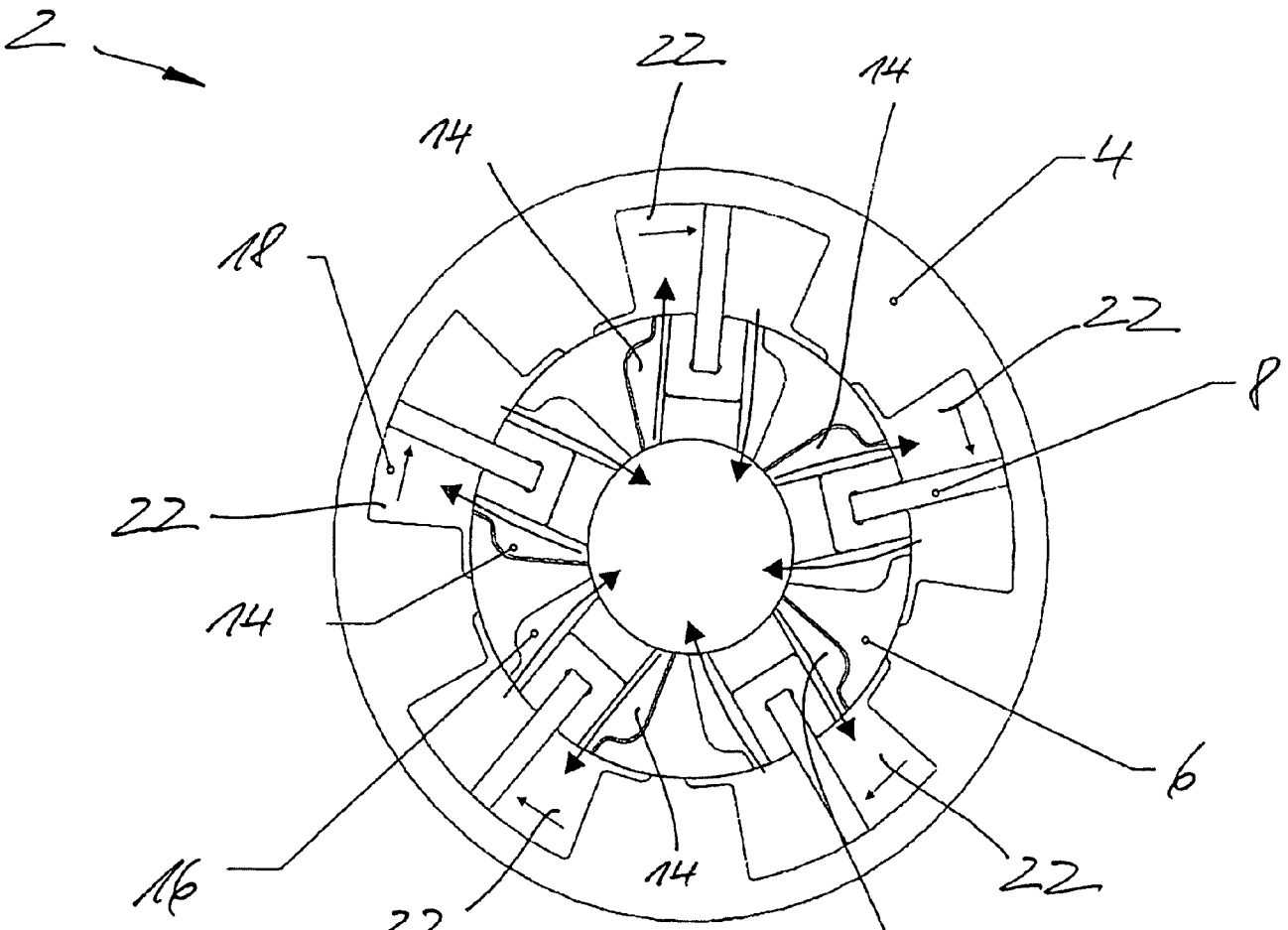
Figure 7:
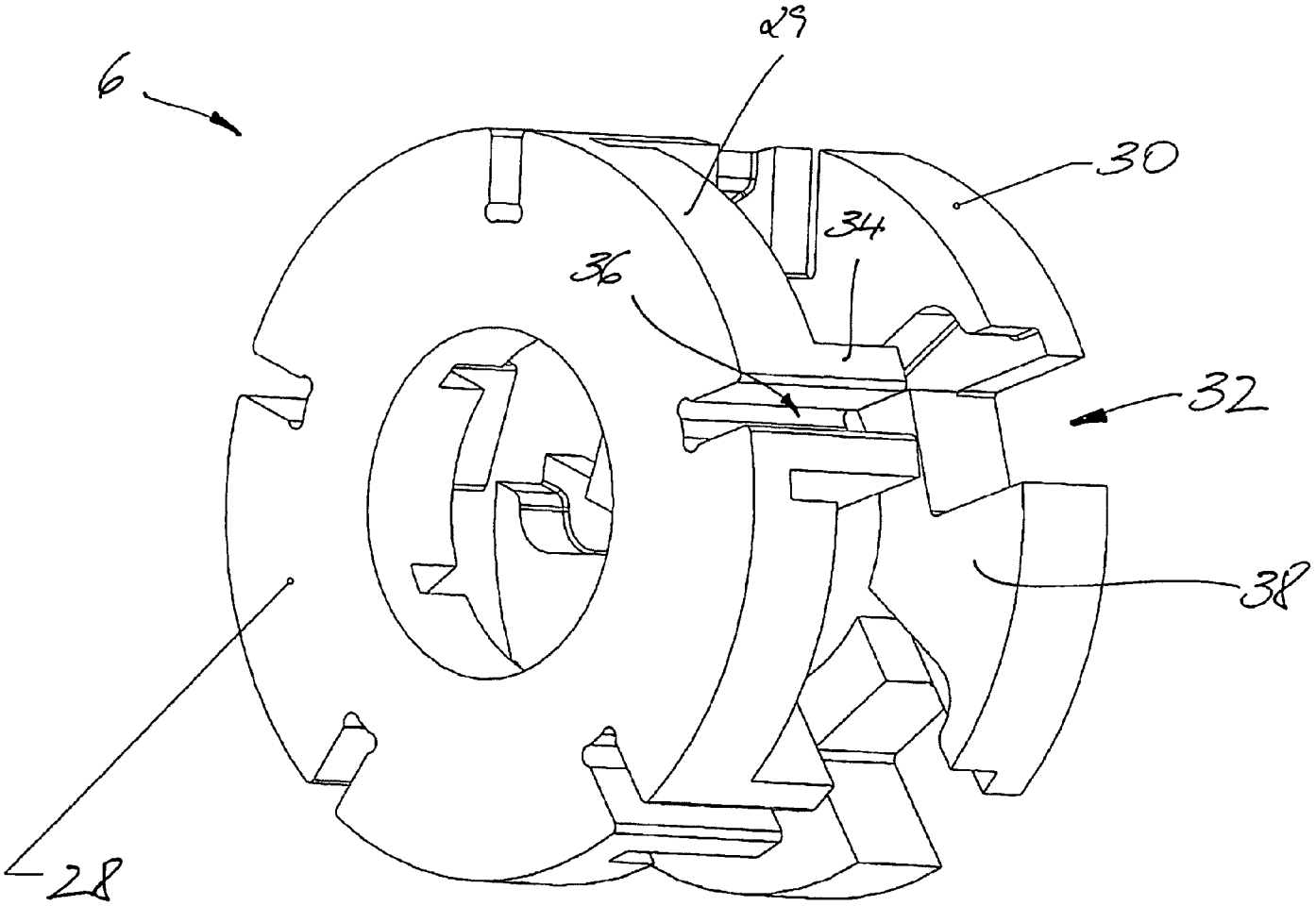
Figure 8:
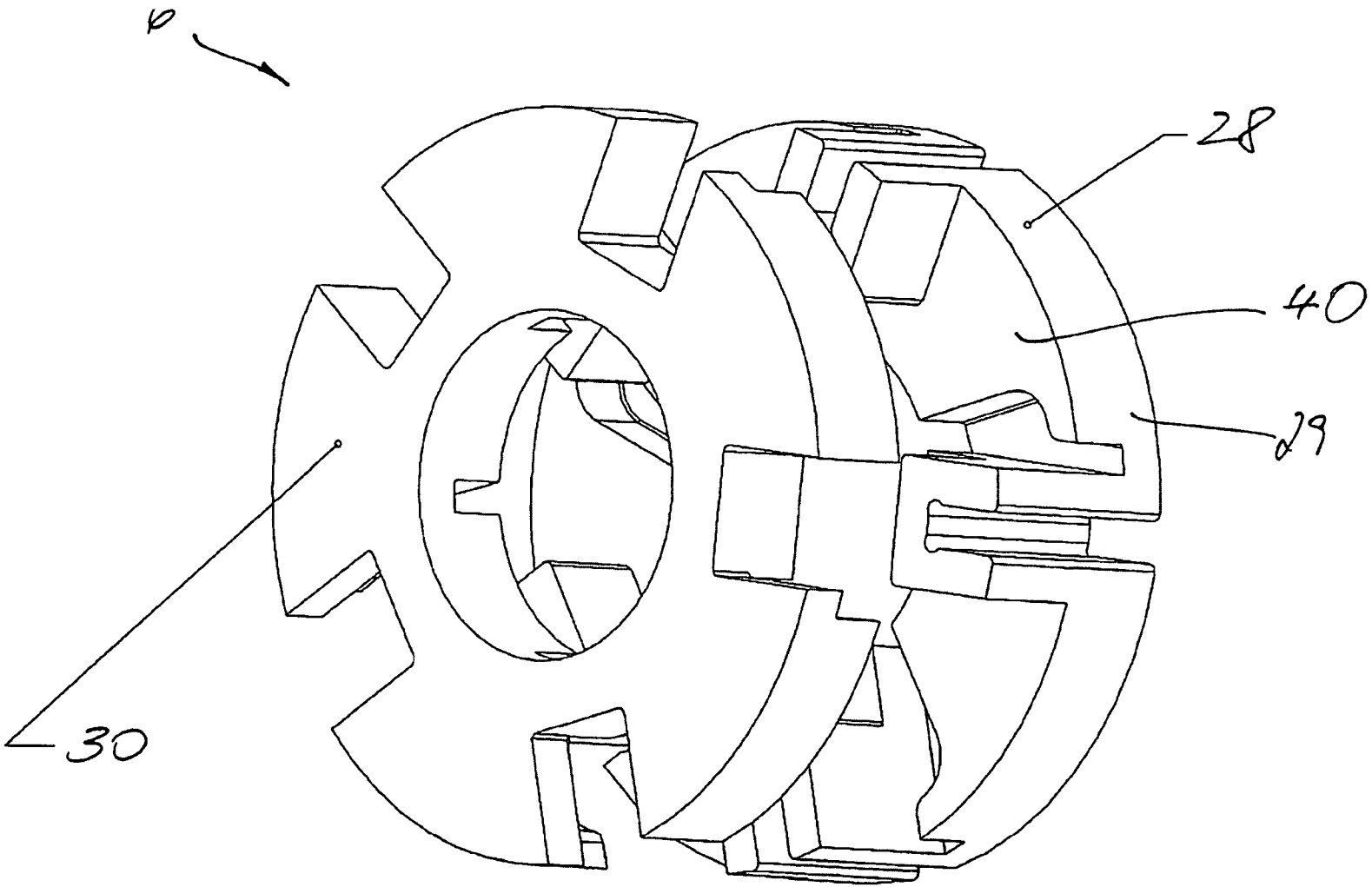
Figure 9:
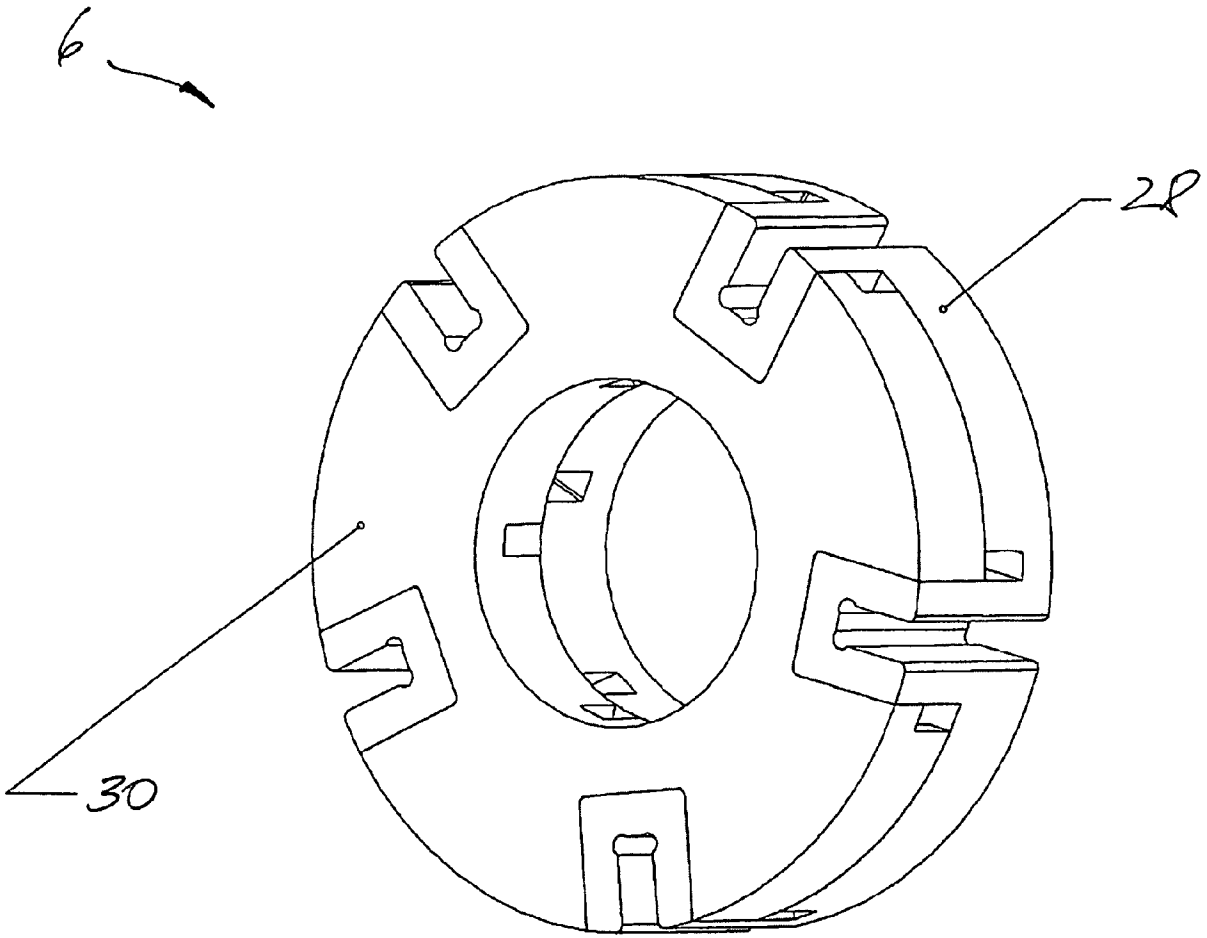
Figure 10:
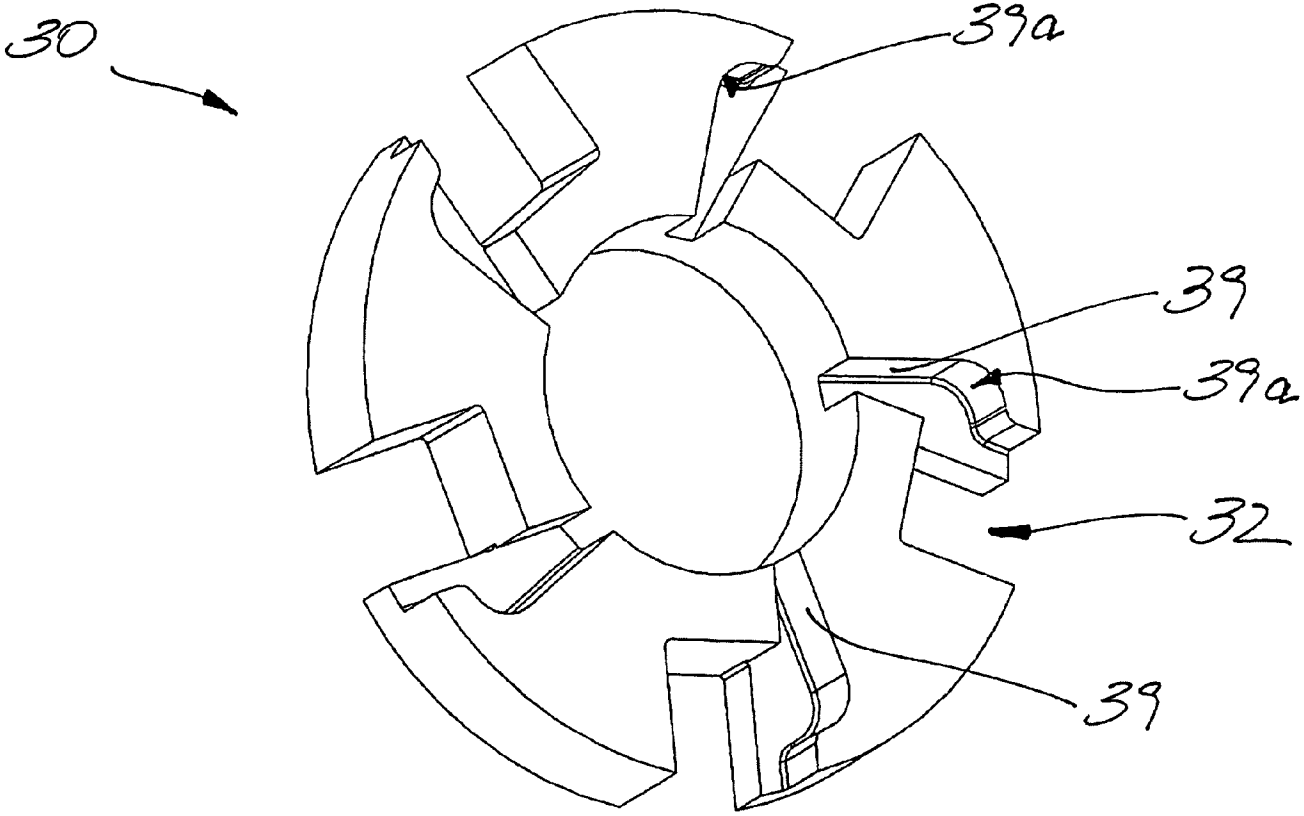
Figure 11:
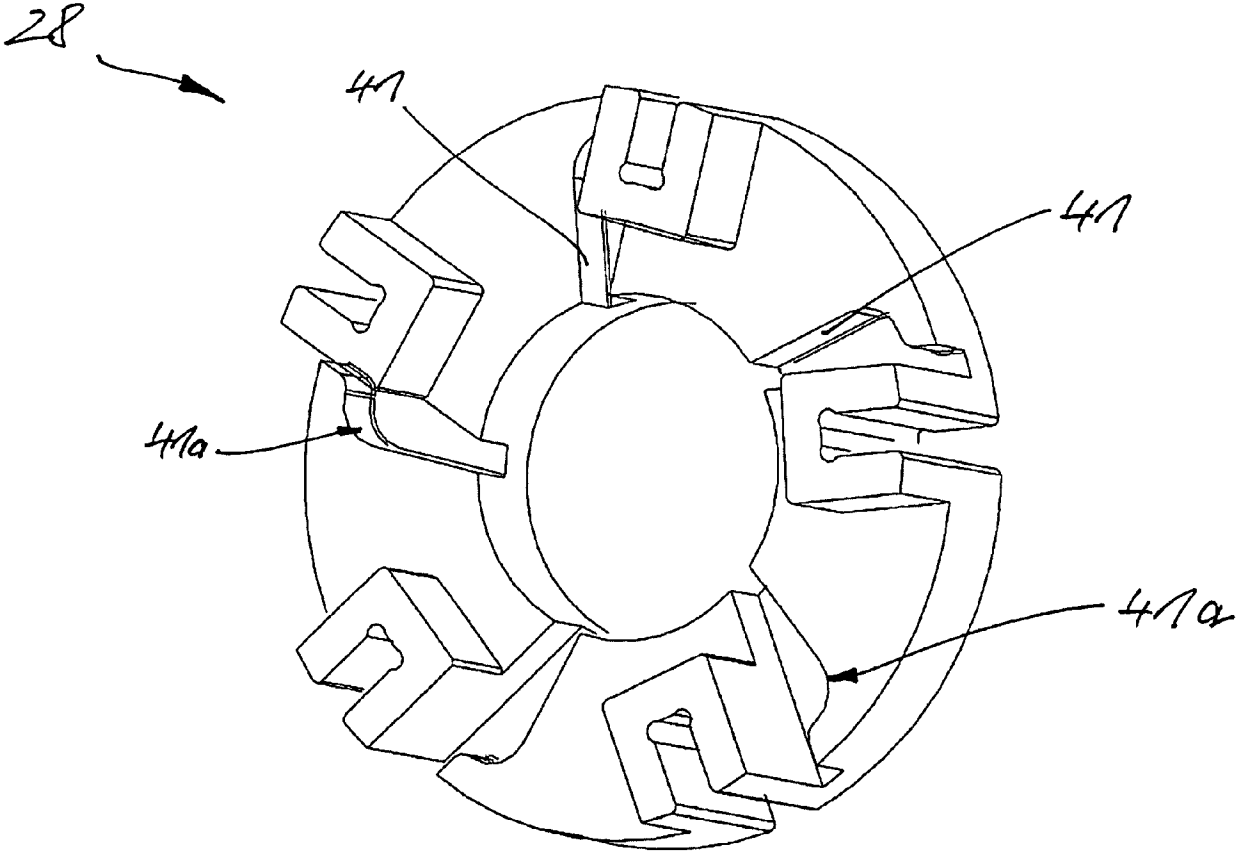
Figure 12:
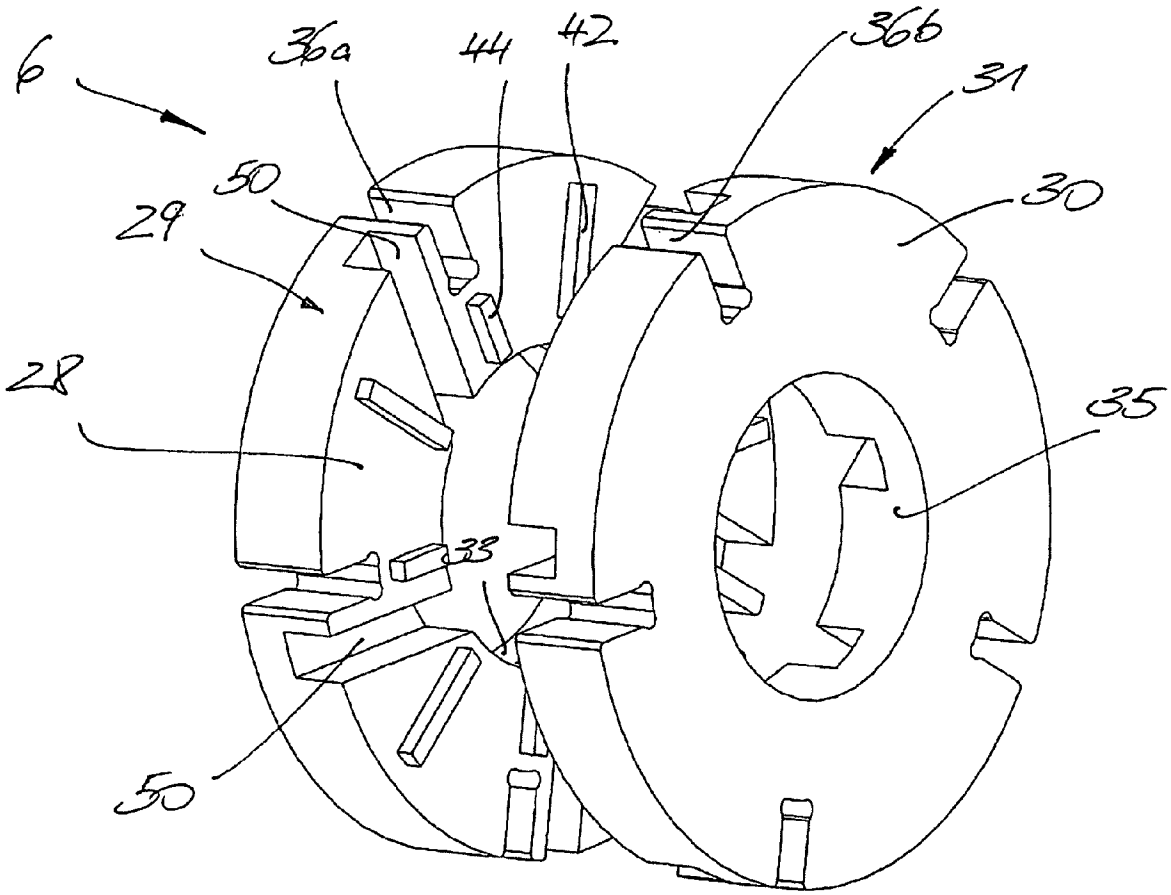
Figure 13:
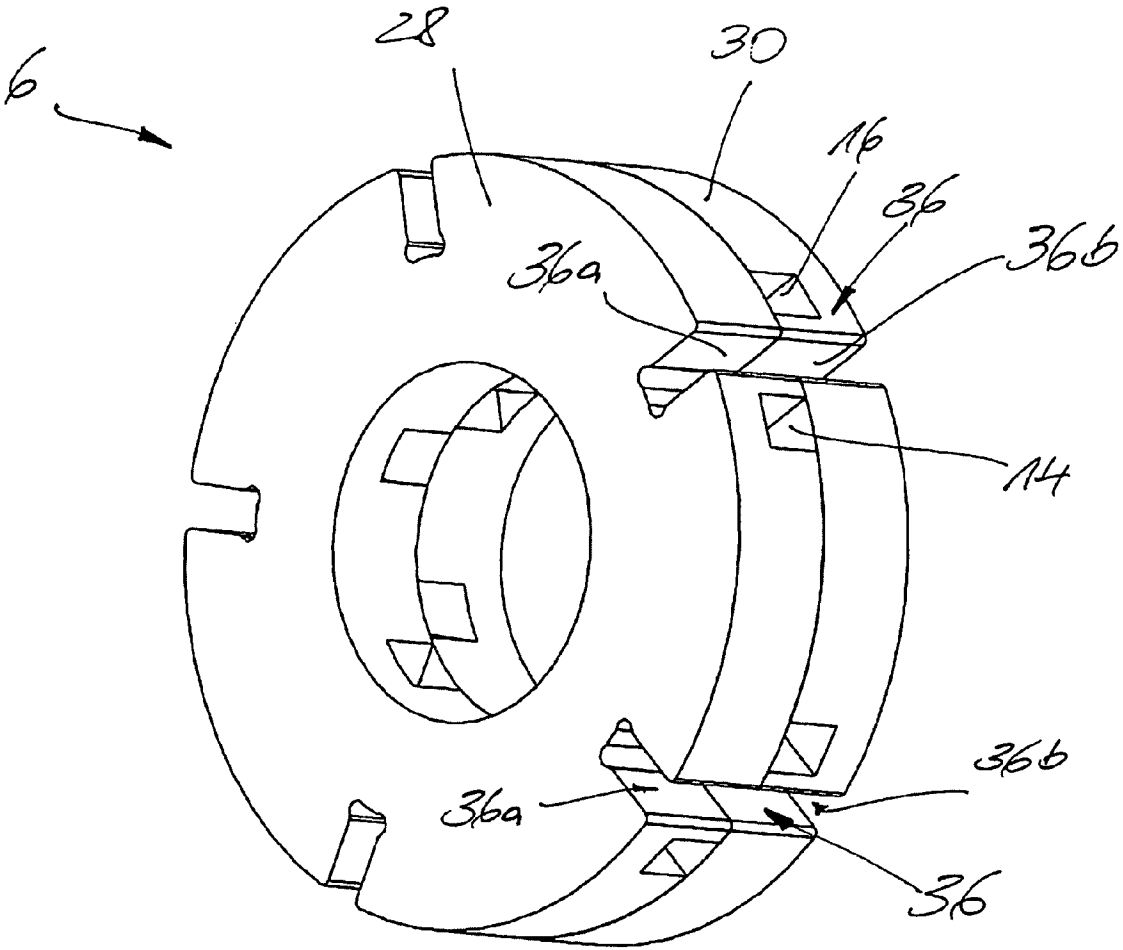
Figure 14:
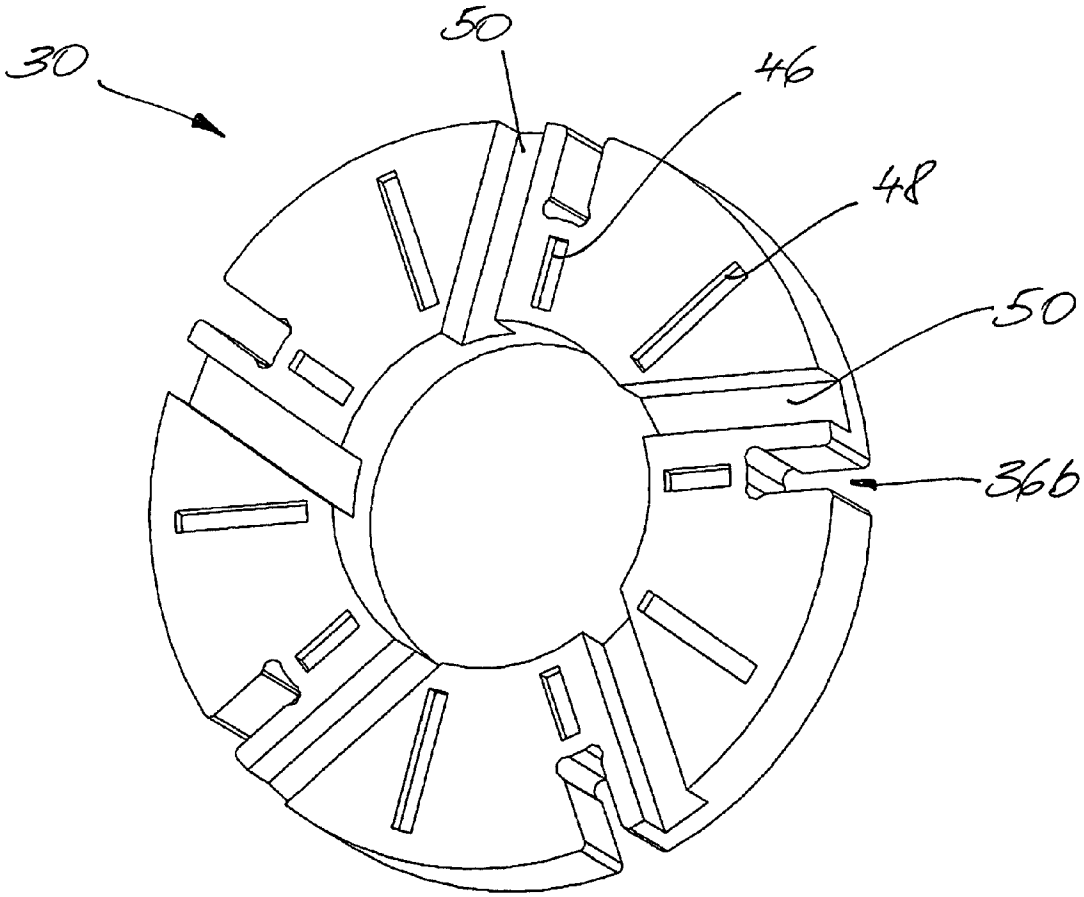
Figure 15:
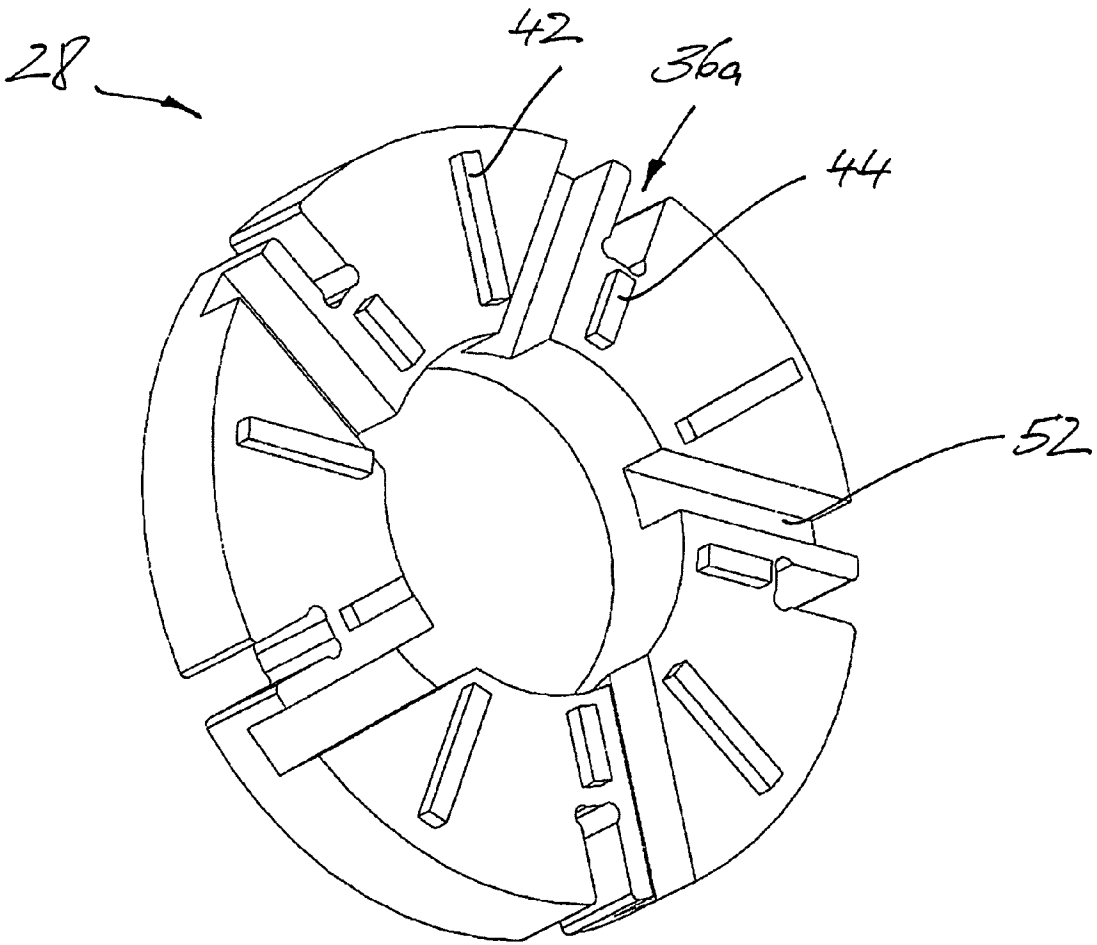
Figure 16:
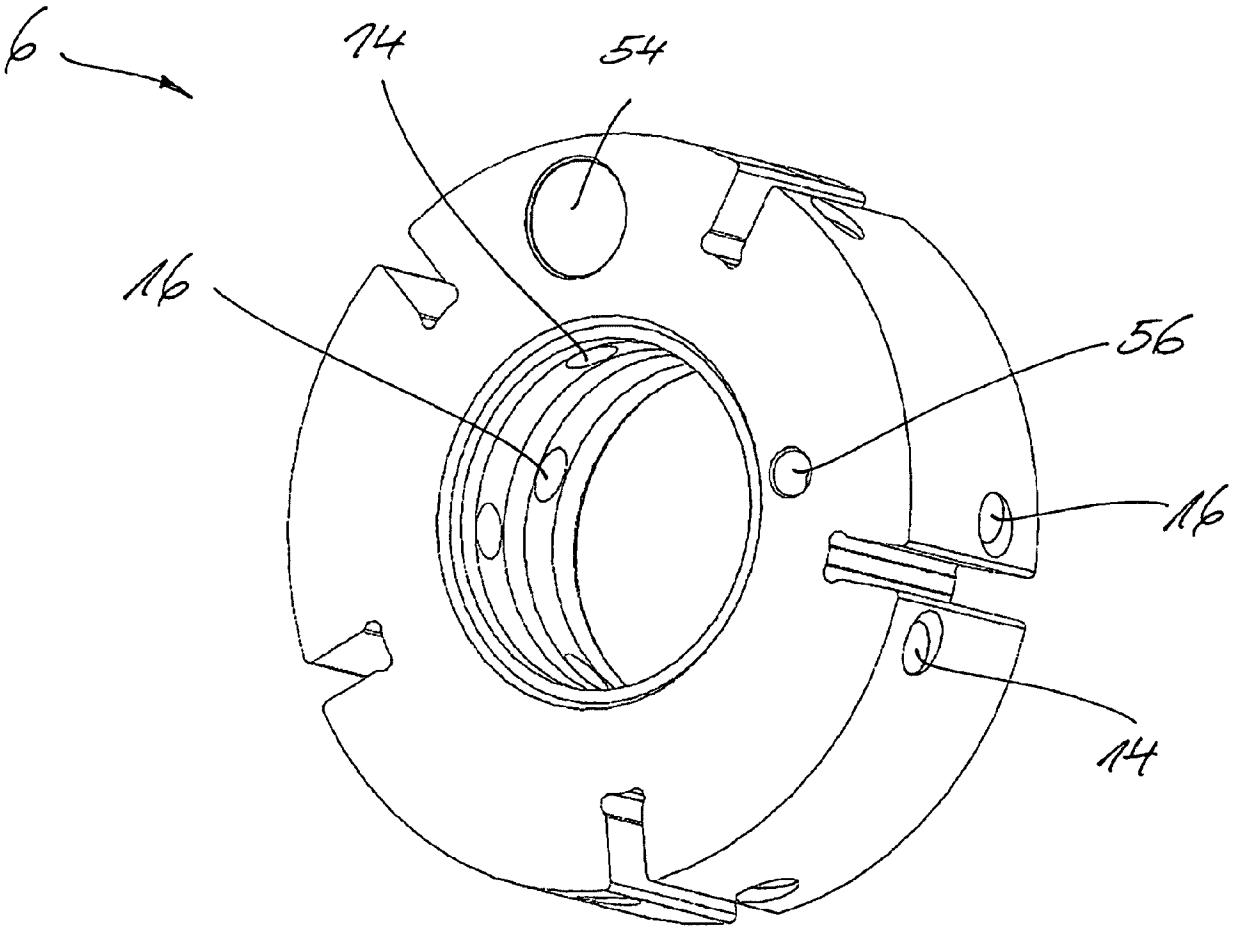
Figure 17:
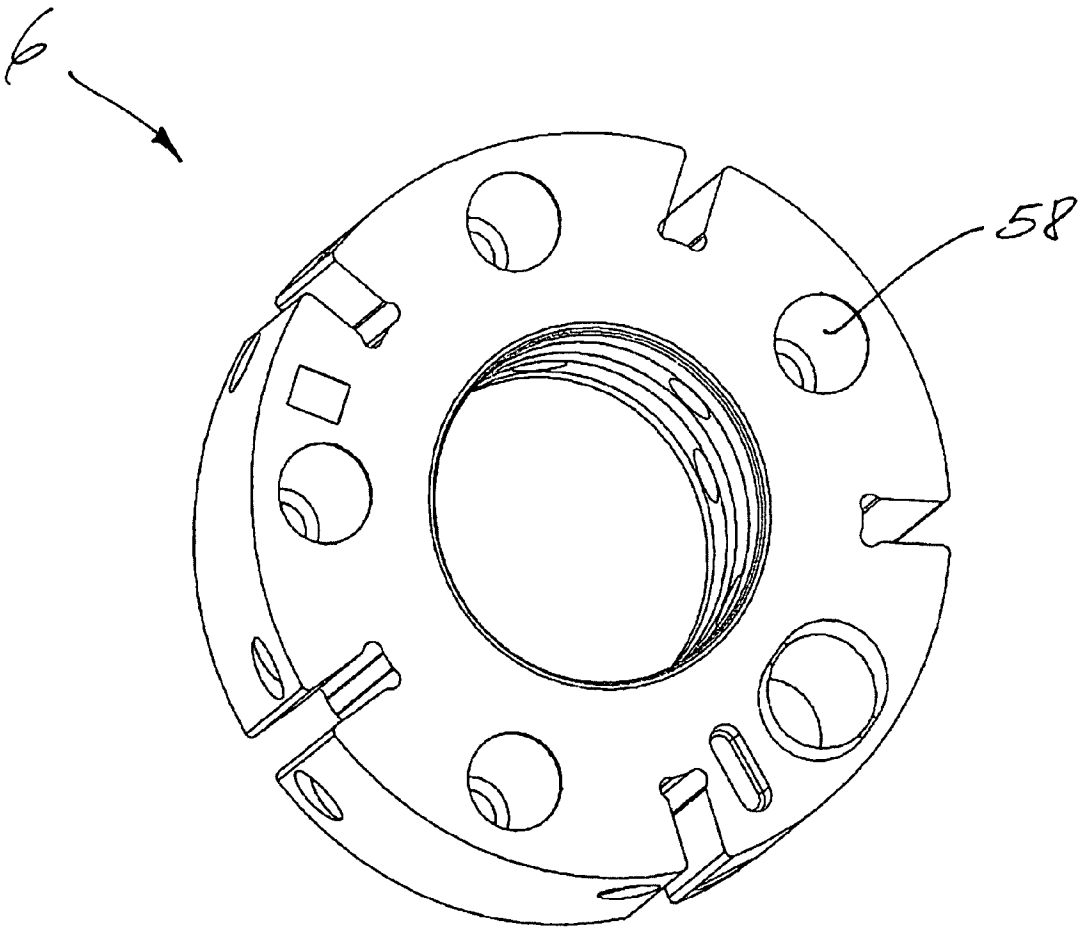

FIG. 4 shows a sectional view along the section line A-A, which is illustrated in FIG. 3, in the direction of the arrows, FIG. 5 shows a further sectional view along the section line A-A, illustrated in FIG. 3, in a direction opposite to the direction of the arrows, FIG. 6 shows a combination of the two sectional views, FIG. 7 shows an exploded illustration of a first embodiment of an inner body in a first perspective view, FIG. 8 shows an exploded illustration of the first embodiment of the inner body in a second perspective view, FIG. 9 shows a perspective view of the first embodiment of the inner body in a fitted-together state, FIG. 10 shows a perspective view of a first element of the first embodiment of the inner body, FIG. 11 shows a perspective view of a second element of the first embodiment of the inner body, FIG. 12 shows an exploded illustration of a second embodiment of the inner body, FIG. 13 shows a perspective view of the second embodiment of the inner body in a fitted-together state, FIG. 14 shows a perspective view of a first element of the second embodiment of the inner body, FIG. 15 shows a perspective view of a second element of the second embodiment of the inner body, FIG. 16 shows a perspective view of an inner body embodiment known from the prior art, FIG. 17 shows a further perspective view of the inner body embodiment known from the prior art, FIG. 18 shows a perspective view of a third embodiment of the inner body in a fitted-together state, FIG. 19 shows a perspective view of an element of the third embodiment of the inner body, FIG. 20 shows a perspective view of a fourth embodiment of the inner body in a fitted-together state, FIG. 21 shows a perspective view of an element of the fourth embodiment of the inner body, and FIG. 22 shows a front view of a further unit of a vane cell adjuster with planet wheels.

FIGS. 1 to 6 show an arrangement 2 of an outer body 4, which is preferably of single-part design, and of an inner body 6, which is of multi-part design and is preferably arranged coaxially on the inside of the outer body 4. The arrangement 2 here forms a unit of a hydraulic camshaft adjuster in the form of a "vane cell adjuster". The outer body 4 can be driven by means of a crankshaft of an internal combustion engine, for example via a gear wheel drive, wherein a toothed belt drive or a chain drive is also possible. By contrast, the inner body 6 can be fixedly connected to a camshaft of the internal combustion engine, which can be introduced into the circular recess 26. A fixed connection here is to be understood as meaning a form-fitting and/or frictional connection. The outer body 4 preferably comprises five hydraulic chambers 18 which are formed by five radially inwardly projecting body sections 20 of the outer body 4. A pivoting vane 8 of the inner body 6 extends in the radial direction info the individual hydraulic chambers 18. The individual pivoting vanes 8 here divide the individual hydraulic chambers 18 into a first working chamber 22 and a second working chamber 24. A driving torque of the crankshaft is introduced by means of the outer body 4 into the camshaft adjuster and is transmitted via the working chambers 22, 24 to the inner body 6 which is fixedly connected to the camshaft.

The inner body 6 preferably comprises fen oil inlet and oil outlet conduits 14, 16 which each extend preferably in the radial direction from a casing interior 10 to a casing exterior 12 of the inner body 6 and as far as one of the ten working chambers 22, 24 such that each of the five hydraulic chambers 18 is assigned two of the ten oil inlet and oil outlet conduits 14, 16. The inner body 6 is pivoted in one direction in relation to the outer body 4 in order to adjust the camshaft by production of a controlled hydraulic pressure in the conduits 14 or 16 and in the associated working chambers 22, 24. Such a pivoting in the clockwise direction is illustrated by means of arrows in FIG. 6 in which the conduits 14 and the associated working chambers 22 are charged with the controlled hydraulic pressure. In this illustration, the conduits 14 act as oil inlet conduits while the conduits 16 act as oil outlet conduits. The arrows shown in FIG. 6 furthermore illustrate the direction of flow of the oil. The inner body 6 is pivoted in the other direction in relation to the outer body 4 in order to adjust the camshaft by production of a controlled hydraulic pressure in the respectively adjacent oil inlet and oil outlet conduit 16 and in the associated working chambers 24. In this case, the conduits 16 act as oil inlet conduits and the conduits 14 act as oil outlet conduits.

The individual hydraulic chambers 18 are of concave configuration corresponding to the circular movement described by the vanes 8, and therefore a pivoting movement of the inner body 6 relative to the outer body 4 can be initiated via the pivoting vanes 8. During the driving of the outer body 4 by the crankshaft, the pivoting vanes 8, which are guided movably in the individual receptacles 36, are pressed against the outer body 4 under the action of a centrifugal force, with the individual working chambers 22, 24 being sealed off from each other.

The pivoting vane sides 8*a* facing the outer body 4 are preferably of flat design, and therefore the working chambers 22, 24 are sealed by the respective longitudinal edges of the pivoting vane sides 8*a* being pressed together. As an alternative thereto, the pivoting vane sides 8*a* may also be of convex configuration. Furthermore, a sealing strip may also be arranged in a groove provided therefor on the individual pivoting vane sides 8*a* irrespective of the flat or convex configuration thereof. A corresponding sealing strip may also be arranged in a groove provided therefor on the individual radial projections 21 of the outer body 4 such that the individual hydraulic chambers 18 are also seated off from one another.

According to an alternative embodiment of the invention (not illustrated in the figures), a spring is arranged between the outer body and the associated pivoting vane in the individual hydraulic chambers in one of two working chambers, said spring having a resetting effect with respect to a pivoting of the inner body.

The inner body 6 illustrated in FIGS. 7 to 9, 12 and 13 is preferably fitted together from a first element 28 and a second element 30 which describe a substantially hollow cylindrical core. FIGS. 7 to 9 illustrate a first embodiment of the inner body 6 while FIGS. 12 and 13 illustrate a second embodiment of the inner body 6. The outer body 4 and the two fitted-together elements 28, 30 are preferably designed as sintered parts. On mutually facing end sides 38, 40, the two elements 28, 30 each have five geometries 39, 41, 50, 52 which together with the respective other element 28, 30 form the oil inlet and oil outlet conduits 14, 16 of the inner body 6. In an advantageous refinement of the invention, the two elements 28, 30 have a substantially radial extent over the circumference. According to the invention, the two elements 28, 30 also have a substantially axial extent over the circumference.

A geometry 39, 41, 50, 52 here should be understood as meaning a recess in the respective element 28, 30, the recess extending from the casing interior 10 as far as the casing exterior 12 of the inner body 6 and not penetrating the element 28, 30 in the longitudinal direction thereof.

In this case, the oil inlet and oil outlet conduits 14, 16 preferably have a quadrangular cross-sectional shape which, in the first embodiment of the inner body 6, is variable with respect to the dimensions thereof and initially increases in the radial direction from the casing interior 10 and then decreases as far as the casing exterior 12. In addition, the geometries 39, 41 have a respective curvature 39*a*, 41*a* but said curvatures are not significant with regard to the manner of operation of the vane cell adjuster. On the contrary, such a configuration of the two elements 28, 30 is justified in a pressing tool design which has the purpose of reinforcing the pressing tool. By contrast, the quadrangular cross-sectional shape of the second embodiment is constant throughout with respect to the dimensions thereof.

In the first embodiment of the inner body 6 (FIGS. 1 to 11), the end side of the element 28 or the end side 40 facing the element 30 comprises five projections 34 which are each configured in the manner of a claw and which each engage in a corresponding recess 32 of the element 30 in a form-fitting manner. The projections 34 here form a respective press fit with the associated recesses 32. The separating gap formed by the two elements 28, 30 is furthermore sealed off hydraulically.

The individual pivoting vanes 8, which are preferably of single-part design, are inserted into the inner body 6 at the casing exterior 12. In this case, five receptacles 36 for the pivoting vanes 8, which receptacles are preferably in the form of a slot and are each formed on one of the projections 34, are provided on the casing exterior 29 of the element 28. The receiving slots 36 are preferably aligned with respect to the longitudinal direction of the inner body 6.

In the second embodiment of the inner body 6 (FIGS. 12 to 15), the end side of the element 28 or the end side 40 facing the element 30 comprises five projections 42 and five projections 44 which are each configured in the manner of a web or a feather key and each engage in a form-fitting manner in a corresponding recess or groove 46, 48 of the element 30. The individual webs 42, 44 and recesses 46, 48 extend here in the radial direction of the inner body 6. Analogously to the first embodiment, the projections 42, 44 here together with the associated recesses 46, 48 form a respective press fit. The separating gap formed by the two elements 28, 30 is likewise sealed off hydraulically. Furthermore, the end sides of the two elements 28, 30 each comprise five grooves 50 which each extend from an associated casing interior 33, 35 as far as an associated casing exterior 29, 31 and, in the fitted-together state of the two elements 28, 30, form a quadrangular cross-sectional shape which, in contrast to the first embodiment, is invariable with respect to the dimensions thereof.

Furthermore, in contrast to the first embodiment, the individual slot recesses 36 are of two-part design. In this case, five receptacles 36*a* are provided on the casing exterior 29 of the element 28, while five receptacles 36*b* ending flush with the receptacles 36*a* are provided on the casing exterior 31 of the element 30.

FIGS. 16 and 17 illustrate an embodiment known from the prior art of an inner body 6 which is of single-part design and has been produced from a metal powder mixture by sintering. Following a sintering operation, the oil inlet and oil outlet conduits 14, 16 have been drilled into the inner body 6. The bores 54, 56, 58 are provided for what are referred to as spring-loaded and hydraulically unlockable locking pins which engage in the bores 54, 56, 58 in order to prevent inadvertent pivoting of the inner body 6 relative to an outer body (not illustrated).

An advantage of the proposed design of the inner body 6 in at least two parts is that the further machining associated with the production of inner bodies of this type by sintering—and also including deburring of the bores—is unnecessary for producing the oil inlet and oil outlet conduits. Said oil inlet and oil outlet conduits are instead produced by fitting together the two elements 28, 30 which together form the inner body 6.

Furthermore, the thinner configuration of the two elements 28, 29*b*, 30 in relation to a single-part configuration of the inner body (FIGS. 16 and 17) advantageously enables lower tolerances to be achieved in the longitudinal direction of the inner body 28, 29*b*, 30 with regard to a height achieved during compaction of metal powders to form "green compacts".

FIG. 18 illustrates a third embodiment of the inner body 6, in which the two fitted-together elements 29*b*—one of which is illustrated in FIG. 19—are of identical design and each preferably have five projections 64 which extend from the casing interior 10 as far as the casing exterior 12 of the inner body 6 and, in order to connect the two elements 29*b*, engage in a corresponding recess 62 in the respective other element 29*b* in a form-fitting manner and, in the process, form a press fit with the associated recesses 62. The projections 64 together with the associated recesses 62 each form an oil inlet and oil outlet conduit 14, 16 of the inner part 6.

An advantage of this configuration is that only one pressing tool is required in conjunction with the previously described production of inner bodies of this type by sintering, in order to produce work pieces of identical configuration.

FIG. 20 illustrates a fourth embodiment of the inner body 6, according to which the two fitted-together elements 29*b* are likewise of identical design. FIG. 21 illustrates one of the two elements 29*b*. However, in contrast to the third embodiment of the inner body 6, pivoting vanes 8 each formed integrally with the hollow cylinder core of the respective element 29*b* are provided instead of the slot-like receptacles 36*a*, 36*b* of the respective elements 29*b* (FIG. 21). In this case, between in each case one of the projections 64 and one of the recesses 62, one of the pivoting vanes 8 extends outward in the radial direction from the hollow cylinder core of the inner body 6. The projections 64 and recesses 62 here are configured analogously to the third embodiment of the inner body 6 (FIGS. 18 and 19).

Analogously to the fourth embodiment of the inner body 6 (FIG. 20), the embodiments described with reference to FIGS. 7 to 15—i.e. the first and the second embodiment of the inner body 6—may alternatively also be provided with pivoting vanes each formed integrally with the hollow cylinder core of the respective inner body 6, instead of the slot-like receptacles 38, 38*a*, 38*b*.

FIG. 22 illustrates an alternative arrangement 2 of an outer body 4, which is preferably of single-part design, and an inner body 6, which is preferably of two-part design and is arranged preferably coaxially on the inside of the outer body 4. In this case, the arrangement 2 preferably forms four hydraulic chambers 18 into each of which a pivoting vane 8 of the inner body 6 extends. The individual pivoting vanes 8 are preferably formed integrally with the hollow cylinder core of the inner body 6. A planet wheel 68*a* is arranged between the individual pivoting vanes 8 and the outer body 4 and is inserted into a pocket 70*a* which is formed on the pivoting vane 8. A gear wheel segment 66 which corresponds to the planet wheel 68*a* and interacts with the planet wheel 68*a* is formed on the respective body sections of the outer body 4 that are assigned to the individual planet wheels 68*a*. In this case, the individual planet wheels 68*a* seal off the working chambers 22, 24 hydraulically from each other.

Furthermore, a planet wheel 68*b* is arranged between the hollow-cylindrical core of the inner body 6 and the outer body 4 on both sides of the respective hydraulic chambers 18. The individual planet wheels 68*b* are inserted into a pocket 70*b* which is formed on the respective radially inwardly projecting body section 20 of the outer body 4. Furthermore, a gear wheel segment 72 is formed on the hollow-cylindrical core of the inner body 6 on both sides of the respective hydraulic chambers 18, said gear wheel segment being designed in a manner corresponding to the associated planet wheel 68*b* and interacting with the latter. In this case, the individual planet wheels 68*b* each seal off two adjacent hydraulic chambers 18 hydraulically from each other.

With regard to the two above-described embodiments, reference is made in respect of further details to the document DE 10 2004 047 817 B3 which has already been mentioned at the beginning and in which such a configuration of a hydraulic camshaft adjuster in the form of a vane cell adjuster is known and which is hereby incorporated fully into the disclosure of the invention.

The invention claimed is:

1. A hydraulic camshaft adjuster for a camshaft of an internal combustion engine, with an outer body which can be driven by means of a crankshaft of the internal combustion engine and has at least one hydraulic chamber, and an inner body which is arranged on the inside of the outer body, can be fixedly connected to the camshaft and has at least one pivoting vane which extends in the radial direction into the hydraulic chamber and divides the hydraulic chamber into a first working chamber and a second working chamber, wherein the inner body has at least one oil inlet and oil outlet conduit extending from a casing interior to a casing exterior of the inner body and as far as one of the two working chambers, wherein the inner body can be pivoted in relation to the outer body in order to adjust the camshaft by production of a controlled hydraulic pressure in the oil inlet and oil outlet conduit and in one of the working chambers, characterized in that the inner body is fitted together at least from a first element and a second element, the two elements each having at least one geometry on mutually facing end sides, said geometry together with the respective other element forming the oil inlet and oil outlet conduit of the inner part; and the two fitted-together elements are of identical design and each have at least one projection which extends from the casing interior as far as the casing exterior, engages, in order to connect the two elements, in a form-fitting manner in a corresponding recess in the respective other element and, in the process, forms a press fit with the recess, the two projections together with the associated recesses each forming an oil inlet and oil outlet conduit of the inner part.

2. The camshaft adjuster as claimed in claim 1, characterized in that the end side of at least one of the two elements has at least one projection which, in order to connect the two elements, engages in a form-fitting manner in a corresponding recess in the other element and, in the process, forms a press fit with the recess.

3. The camshaft adjuster as claimed in claim 2, characterized in that the projection is formed in the manner of a claw.

4. The camshaft adjuster as claimed in claim 2, characterized in that the projection is formed in the manner of a web.

5. The camshaft adjuster as claimed in claim 1, characterized in that the two elements have a substantially identical radial extent over the circumference.

6. The camshaft adjuster as claimed in claim 1, characterized in that the two elements have a substantially identical axial extent over the circumference.

7. The camshaft adjuster as claimed in claim 1, characterized in that the oil inlet and oil outlet conduit extends in the radial direction from the casing interior to the casing exterior of the inner body.

8. The camshaft adjuster as claimed in claim 1, characterized in that the oil inlet and oil outlet conduit has a quadrangular cross-sectional shape which is either constant or variable with respect to the dimensions thereof.

9. The camshaft adjuster as claimed in claim 1, characterized in that at least one first oil inlet and oil outlet conduit and one second oil inlet and oil outlet conduit are provided, the first oil inlet and oil outlet conduit extending as far as one of the two working chambers while the second oil inlet and oil outlet conduit extends as far as the other working chamber.

10. The camshaft adjuster as claimed in claim 1, characterized in that the pivoting vane is formed integrally with the inner body.

11. The camshaft adjuster as claimed in claim 1, characterized in that the pivoting vane is inserted into the inner body at the casing exterior.

12. The camshaft adjuster as claimed in claim 11, characterized in that a receptacle for the pivoting vane is provided on at least one of the two elements at the casing exterior.

13. The camshaft adjuster as claimed in claim 12, characterized in that the receptacle is formed on the projection.

14. The camshaft adjuster as claimed in claim 12, characterized in that the receptacle is formed in the manner of a slot.

15. The camshaft adjuster as claimed in claim 14, characterized in that the slot-like receptacle is aligned with respect to the longitudinal direction of the inner body.

16. The camshaft adjuster as claimed in claim 11, characterized in that the pivoting vane is guided movably in the receptacle.

17. The camshaft adjuster as claimed in claim 1, characterized in that the outer body and the two fitted-together elements of the inner body are designed as sintered parts.

18. A hydraulic camshaft adjuster for a camshaft of an internal combustion engine, with an outer body which can be driven by means of a crankshaft of the internal combustion engine and has at least one hydraulic chamber, and an inner body which is arranged on the inside of the outer body, can be fixedly connected to the camshaft and has at least one pivoting vane which extends in the radial direction into the hydraulic chamber and divides the hydraulic chamber into a first working chamber and a second working chamber, wherein the inner body has at least one oil inlet and oil outlet conduit extending from a casing interior to a casing exterior of the inner body and as far as one of the two working chambers, wherein the inner body can be pivoted in relation to the outer body in order to adjust the camshaft by production of a controlled hydraulic pressure in the oil inlet and oil outlet conduit and in one of the working chambers, characterized in that the inner body is fitted together at least from a first element and a second element, the two elements each having at least one geometry on mutually facing end sides, said geometry together with the respective other element forming the oil inlet and oil outlet conduit of the inner part;

the pivoting vane is inserted into the inner body at the casing exterior;

a receptacle for the pivoting vane is provided on at least one of the two elements at the casing exterior; and a receptacle for the pivoting vane is provided on both elements.

19. A hydraulic camshaft adjuster for a camshaft of an internal combustion engine, with an outer body which can be driven by means of a crankshaft of the internal combustion engine and has at least one hydraulic chamber, and an inner body which is arranged on the inside of the outer body, can be fixedly connected to the camshaft and has at least one pivoting vane which extends in the radial direction into the hydraulic chamber and divides the hydraulic chamber into a first working chamber and a second working chamber, wherein the inner body has at least one oil inlet and oil outlet conduit extending from a casing interior to a casing exterior of the inner body and as far as one of the two working chambers, wherein the inner body can be pivoted in relation to the outer body in order to adjust the camshaft by production of a controlled hydraulic pressure in the oil inlet and oil outlet conduit and in one of the working chambers, characterized in that the inner body is fitted together at least from a first element and a second element, the two elements each having at least one geometry on mutually facing end sides, said geometry together with the respective other element forming the oil inlet and oil outlet conduit of the inner part;

the two fitted-together elements are of identical design and each have at least one projection which extends from the casing interior as far as the casing exterior, engages, in order to connect the two elements, in a form-fitting manner in a corresponding recess in the respective other element and, in the process, forms a press fit with the recess, the two projections together with the associated recesses each forming an oil inlet and oil outlet conduit of the inner part; and a planet wheel is arranged between the pivoting vane and the outer body, a gear wheel segment corresponding to the planet wheel being formed on the outer body, and a pocket into which the planet wheel is inserted being formed on the pivoting vane.

20. A hydraulic camshaft adjuster for a camshaft of an internal combustion engine, with an outer body which can be driven by means of a crankshaft of the internal combustion engine and has at least one hydraulic chamber, and an inner body which is arranged on the inside of the outer body, can be fixedly connected to the camshaft and has at least one pivoting vane which extends in the radial direction into the hydraulic chamber and divides the hydraulic chamber into a first working chamber and a second working chamber, wherein the inner body has at least one oil inlet and oil outlet conduit extending from a casing interior to a casing exterior of the inner body and as far as one of the two working chambers, wherein the inner body can be pivoted in relation to the outer body in order to adjust the camshaft by production of a controlled hydraulic pressure in the oil inlet and oil outlet conduit and in one of the working chambers, characterized in that the inner body is fitted together at least from a first element and a second element, the two elements each having at least one geometry on mutually facing end sides, said geometry together with the respective other element forming the oil inlet and oil outlet conduit of the inner part;

the two fitted-together elements are of identical design and each have at least one projection which extends from the casing interior as far as the casing exterior, engages, in order to connect the two elements, in a form-fitting manner in a corresponding recess in the respective other element and, in the process, forms a press fit with the recess, the two projections together with the associated recesses each forming an oil inlet and oil outlet conduit of the inner part; and a planet wheel is arranged between a hollow cylinder core of the inner body and the outer body on both sides of the hydraulic chamber, a gear wheel segment corresponding to the planet wheel being formed on the hollow cylinder core on both sides of the hydraulic chamber, and a pocket into which the associated planet wheel is inserted being formed on the outer body on both sides of the hydraulic chamber.

* * * * *

UNITED STATES PATENT AND TRADEMARK OFFICE

CERTIFICATE OF CORRECTION

PATENT NO. : 8,550,046 B2
APPLICATION NO. : 12/966774
DATED : October 8, 2013
INVENTOR(S) : Bernhard Terfloth et al.

It is certified that error appears in the above-identified patent and that said Letters Patent is hereby corrected as shown below:

In the Specification

Col. 2, line 30 “part, in” should be -- part. In --.

Col. 5, line 20 “fen oil” should be -- ten oil --.

Col. 5, line 64 “seated” should be -- sealed --.

Col. 8, line 4 “38, 38a, 38b” should be -- 36, 36a, 36b --.

Signed and Sealed this
First Day of April, 2014

Michelle K. Lee

Michelle K. Lee
*Deputy Director of the United States Patent and Trademark Office*